US007823433B2

(12) United States Patent
Zhang

(10) Patent No.: US 7,823,433 B2
(45) Date of Patent: Nov. 2, 2010

(54) RATCHET CRIMPING TOOL

(75) Inventor: Hanzhen Zhang, Beichen District (CN)

(73) Assignee: Tianjin Runshi Technology Development Co., Ltd., Tianjin (CN)

( * ) Notice: Subject to any disclaimer, the term of this patent is extended or adjusted under 35 U.S.C. 154(b) by 18 days.

(21) Appl. No.: 12/293,789

(22) PCT Filed: Oct. 31, 2006

(86) PCT No.: PCT/CN2007/070150

§ 371 (c)(1),
(2), (4) Date: Oct. 20, 2008

(87) PCT Pub. No.: WO2008/037189

PCT Pub. Date: Apr. 3, 2008

(65) Prior Publication Data

US 2009/0120245 A1 May 14, 2009

(30) Foreign Application Priority Data

Sep. 27, 2006 (CN) ..... 2006 2 0027421 U

(51) Int. Cl.
*B25B 7/12* (2006.01)

(52) U.S. Cl. ..... 72/409.07; 72/409.01; 72/409.11; 72/449

(58) Field of Classification Search . 72/409.01–409.19, 72/449; 81/314–315, 325, 328, 356–357, 81/392

See application file for complete search history.

(56) References Cited

U.S. PATENT DOCUMENTS 5,432,995 A * 7/1995 Takenami et al. ..... 29/753
6,434,998 B2 8/2002 Amherd et al.
6,612,147 B2 * 9/2003 Beetz et al. ..... 72/409.16
7,059,166 B2 * 6/2006 Bowles et al. ..... 72/413
7,284,330 B2 10/2007 Wagner et al.
2001/0006001 A1 7/2001 Battenfeld
2007/0289353 A1 12/2007 Fiorisi

* cited by examiner

*Primary Examiner*—Dana Ross
*Assistant Examiner*—Matthew G Katcoff
(74) *Attorney, Agent, or Firm*—Workman Nydegger

(57) ABSTRACT

A ratchet crimping tool is disclosed. The ratchet crimping tool comprises a tool head cover board structure, a tool handle structure, a transmission device, and a tool handle. The transmission device further comprises an anti-backup mechanism, an advancement mechanism and a gear structure. The ratchet crimping tool uses a coaxial tool head, a confirming-indicating device and an adjustable jaw structure. The coaxial tool head comprises a movable tool handle and a fixed tool handle. A gear of the movable tool head is engaged with the gear structure of the transmission device, and the adjustable jaw structure is connected with the movable tool handle. The confirming-indicating device is connected with the movable tool handle and the fixed tool handle respectively. The coaxial tool head is connected with a tool head cover board structure by link pins, and the gear structure of the transmission device is connected with the movable tool handle by connecting pins via upper and lower cover boards. The fixed tool handle is connected with an anti-backup mechanism of the transmission device by connecting pins via the upper and lower cover boards. Between the advancement mechanism of the transmission device and the movable tool handle, a connection is established by advancement of the connecting pins.

11 Claims, 3 Drawing Sheets

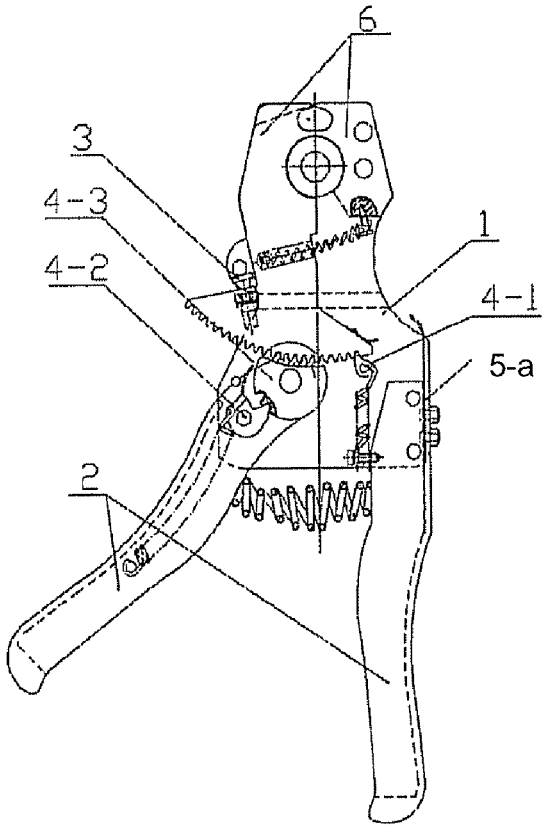
FIG. 1
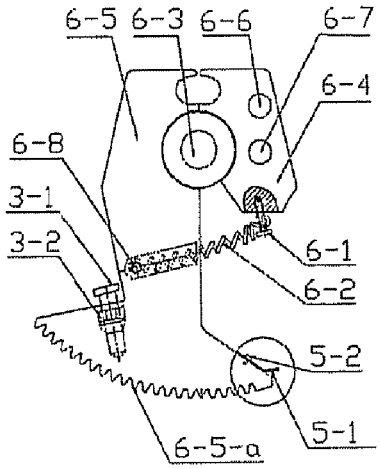
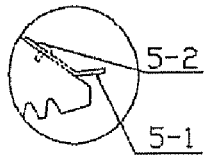
FIG. 2A FIG. 2B
FIG. 2

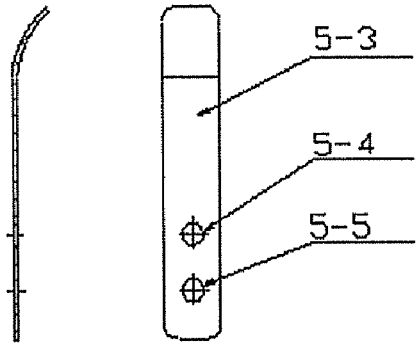
FIG. 3A
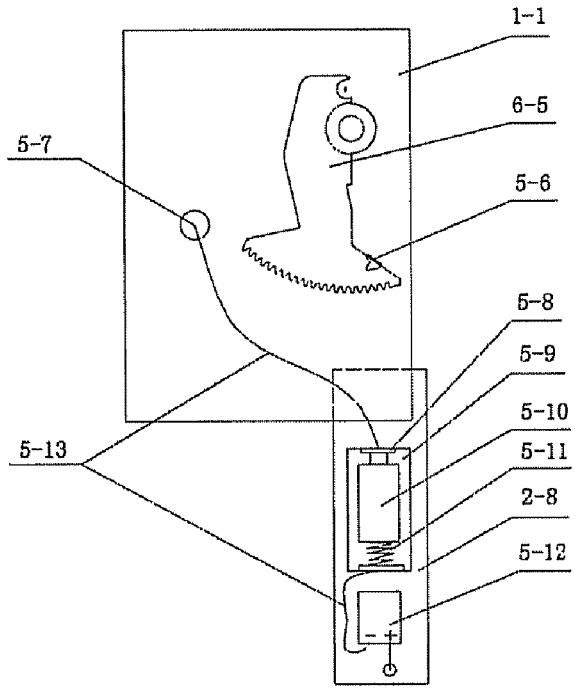
FIG. 3B
FIG. 3
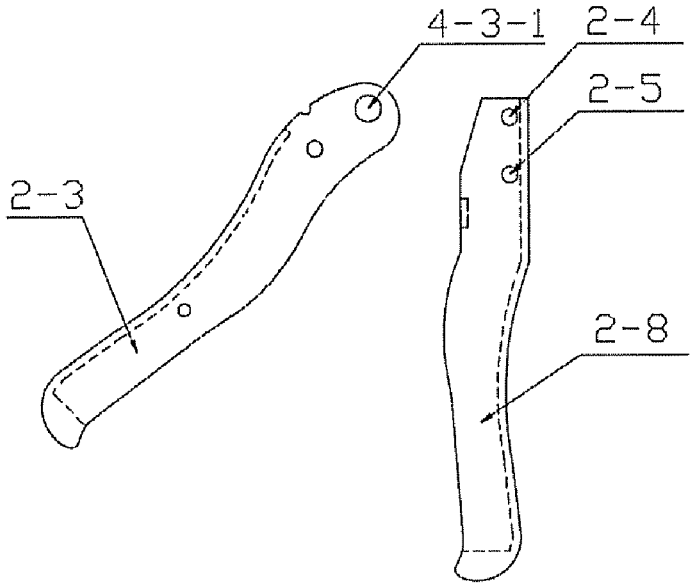
FIG. 4

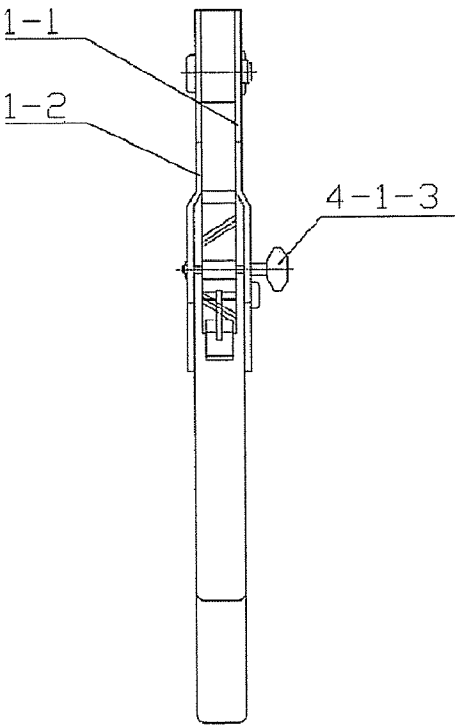
FIG. 5B
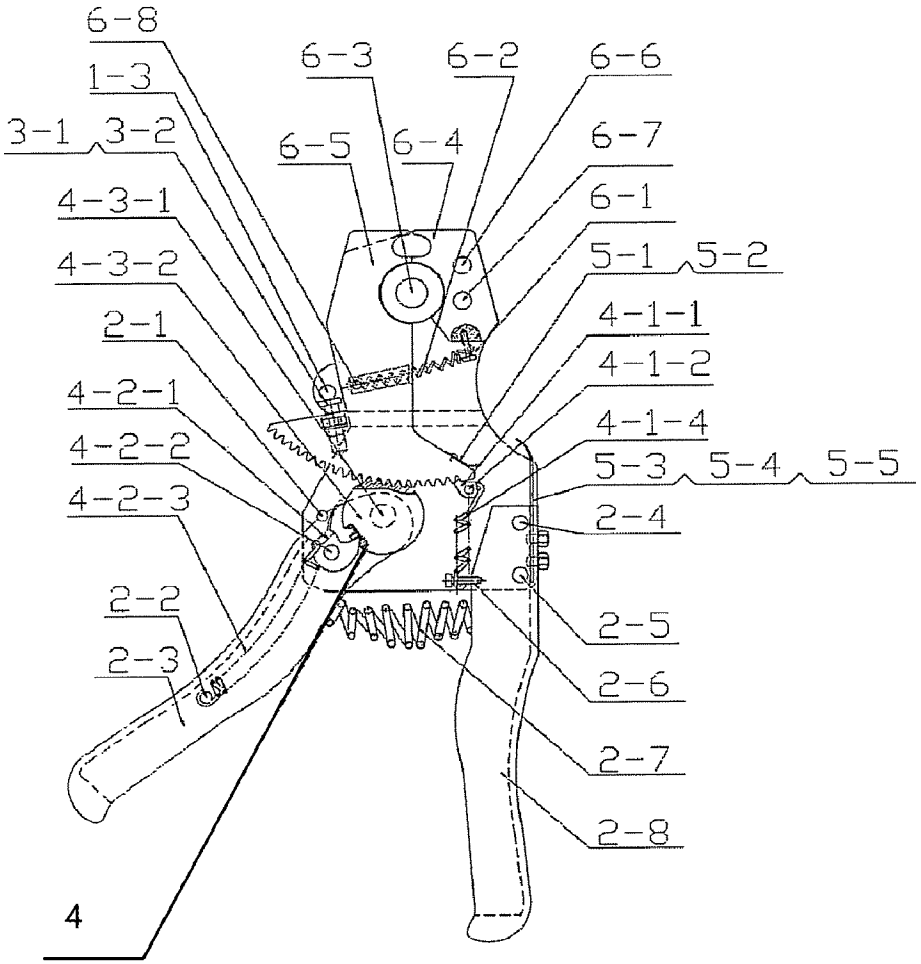
FIG. 5A
FIG. 5

RATCHET CRIMPING TOOL

CROSS REFERENCE TO RELATED APPLICATIONS

This application is a National Stage application which claims the benefit of International Application No. PCT/CN2007/070150 filed Oct. 31, 2006 which claims priority based on China Application No. 200620027421.4, filed Sep. 27, 2006, all of which are hereby incorporated by reference in their entirety.

TECHNICAL FIELD

The present disclosure relates to hardware tools, and more particularly, to a ratchet crimping tool.

BACKGROUND

It is impossible for existing ratchet crimping tools to realize accurate positioning, as the jaw of which is not adjustable, and existing ratchet tools have no confirming-indicating mark. In addition, it is time-consuming and energy-consuming to achieve accurate positioning. Furthermore, it is hard to apply force with the tool handle. Accordingly, a kind of hardware tool that can adjust the speed of use, is desirable.

SUMMARY

The present disclosure aims to provide a ratchet crimping tool, the tool handle of which conforms to human engineering and the workload of the jaw is selectively adjustable. The ratchet crimping tool not only overcomes the disadvantages of existing ratchet crimping tools, but also is lightweight and easy to use. Therefore, the disclosed ratchet crimping tool has strong practicality.

A ratchet crimping tool comprises a tool head cover board structure, a tool handle structure, a transmission device and a tool head. The transmission device comprises an anti-backup mechanism, an advancement mechanism and gear structure. The ratchet crimping tool uses a coaxial tool head, a confirming-indicating device and an adjustable jaw structure. The coaxial tool head comprises a movable tool head and a fixed tool head, the gear of the movable tool head is engaged with the gear of the transmission device, and the adjustable jaw structure is connected with the movable tool head. The confirming-indicating device is connected with the movable tool head and the fixed tool handle, respectively. The coaxial tool head is connected with the tool head cover board structure by link pins. The gear of the transmission device is connected with the movable tool handle by connecting pins via upper and lower cover boards. The fixed tool handle is connected with the anti-backup mechanism of the transmission device by the connecting pins via upper and lower cover boards. Between the advancement mechanism of the transmission device and the movable tool handle, it establishes a connection by the advancement of connecting pins.

The coaxial tool head comprises a movable tool head and a fixed tool head, which are provided with circular concave parts, generally the same size, respectively, and each center of the concave parts is provided with a hole with substantially the same general size. The holes are connected with the upper and lower cover boards by link pins. There is a fixed screw on the fixed tool head and a fixed screw on the movable tool head. Springs for opening and closing the jaw of the movable tool head are connected with the fixed screw and the fixed screw, respectively. A gear is disposed under the movable tool head.

The adjustable jaw structure comprises a screw of the adjustable jaw and a screw cap of the adjustable jaw. The movable tool head is provided with a hole, the diameter of which is substantially the same as the external diameter of the screw cap. The screw cap is inserted into the hole of movable tool head and the screw is screwed into the screw cap. There are corresponding circle numbers disposed between the screw and the screw cap for adjusting the opening degree of the jaw.

The confirming-indicating device produces audio or visual signals when the tool handle closes to a certain designated position under the action of the transmission device. There are two types of the confirming-indicating device; one is a mechanical mechanism confirming-indicating device, and the other is an electronic mechanism confirming-indicating device.

The mechanical mechanism confirming-indicating device comprises two parts: one part is an audio or visual signal spring which is connected with the movable tool head by a screw, and the other is an audio or visual signal spring being connected with the fixed tool handle by one of two different screws.

The electronic mechanism confirming-indicating device comprises a contact of the movable tool head, a contact of the cover board, metal sheet positive and negative plates, a battery box, a battery, a spring, a signal device and conducting wires. The contacts of the movable tool head and cover board are disposed inside the movable tool head and the upper cover board, respectively. The metal sheets plates, battery box, battery, spring and signal device are disposed inside the fixed tool handle. The contact of the cover board is connected with the metal sheet positive electrode plate of the battery. The metal sheet negative electrode plate of the battery is connected with the negative electrode of the signal device. The positive electrode of the signal device is connected with the fixed tool handle. When the movable tool head is closed to a designated position, the contact of the movable tool head contacts with the contact of cover board, which means the positive electrode and negative electrode of battery contacts, then the signal device produces an audio or visual signal.

The tool handle structure, which conforms to human engineering, comprises a movable tool handle and a fixed tool handle. The movable tool handle is connected with the gear by connecting pins and the cover board. The holes of two tool handles of the fixed tool handle are connected with the upper and lower cover boards by respective connecting pins, respectively. The fixed screw disposed at one side of the fixed tool handle is connected with one end of the spring, the other end of which is connected with the backstop. The shape of the two tool handles is structured to be comfortable for users to use and laborsaving.

The anti-backup mechanism of the transmission device comprises a backstop which prevents the return of the movable tool head and a spring. One end of the backstop is teeth shaped and the other end is provided with a small hole which is connected with one end of the spring. The other end of the spring is connected with the fixed screw disposed inside the fixed tool handle.

The advancement mechanism of the transmission device is disposed inside the movable tool handle and comprises an advancement and a spring. One end of the advancement is teeth shaped and the other end has small hole which is connected with one end of the spring. An opposite end of the spring is connected with the fixed pin, which is inserted in the movable tool handle. The teeth shaped end of the advancement is engaged with the gear. Advancement is fixed inside the movable tool handle by advancement connecting pins.

The cover board structure comprises two bending boards which comprise an upper cover board and lower cover board. The upper cover board and lower cover board are coaxially connected to the movable tool head and fixed tool head by link pins, respectively. The gear and the movable tool handle are disposed between the upper and lower cover boards. The backstop is disposed between the upper and lower cover boards and connected to the upper and lower cover boards by connecting pins. The fixed tool handle is fixed between the upper and lower cover boards by pins on the fixed tool handle.

The principle of the disclosure is as follows. First, the opening degree of the jaw may be selectively adjusted by the adjustable jaw structure according to need, then the tool handle structure, which conforms to human engineering, applies force. The spring between tool handles can repeatedly push the handles. Meanwhile, the advancement mechanism inside the movable tool handle moves the gear when the movable tool handle is repeatedly operated, and the gear is engaged with the movable tool head, and the anti-backup mechanism prevents return of the movable tool head. Accordingly, the movable tool head opens and closes step by step. The confirming-indicating device produces an audio or visual signal or light when the tool head is clipped to the designated position. Finally, the whole operation is finished.

Advantages of the utility model are as follows:

1. the force positioning of the coaxial tool head is accurate;
2. the opening degree of the jaw is selectively adjustable;
3. an audio or visual signal or light is produced when quickly clipped to a designated position, which is laborsaving and timesaving;
4. various functions (tightening, cutting and shearing) are realized; and
5. it is easy for the tool handle to apply force, which is convenient to use and easy to operate.

BRIEF DESCRIPTION OF THE DRAWINGS

FIG. 1 is a schematic view of the integral basic structure of an embodiment of a ratchet crimping tool according to the disclosure;

FIG. 2 is a schematic view of a coaxial tool head of a ratchet crimping tool according to the disclosure (FIG. 2*a* is the schematic view of a tool head, FIG. 2*b* is the schematic view of a mechanical mechanism confirming-indicating device);

FIG. 3 is a schematic view of a confirming-indicating structure of a ratchet crimping tool according to the disclosure (FIG. 3*a* is the schematic view of a mechanical mechanism confirming-indicating structure, FIG. 3*b* is the schematic view of an electronic mechanism confirming-indicating structure);

FIG. 4 is a schematic view of a tool handle structure of a ratchet crimping tool according to the disclosure;

FIG. 5 is a schematic view of an integral refining structure of a ratchet crimping tool according to the disclosure.

DETAILED DESCRIPTION

A first embodiment of a ratchet crimping tool is shown in FIGS. 1 and 5. The ratchet crimping tool comprises a tool head cover board structure 1 comprising an upper cover board 1-1 and a lower cover board 1-2, a tool handle structure 2 comprising a movable tool handle 2-3 and a fixed tool handle 2-8, a transmission device 4 comprising an anti-backup mechanism 4-1, an advancement mechanism 4-2, and a gear structure 4-3, and a tool head. The step tool uses a coaxial tool head 6, a confirming-indicating device 5 and an adjustable jaw structure 3. The coaxial tool head 6 comprises a movable tool head 6-5 and a fixed tool head 6-4. The gear 6-5-*a* of the movable tool head is engaged with the gear 4-3-2 of the transmission device 4, and the adjustable jaw structure 3 is connected with the movable tool head 6-5. The confirming-indicating device 5 is connected with the movable tool head 6-5 and the fixed tool handle 2-8, respectively. The coaxial tool head 6 is connected with the tool head cover board structure 1 by the link pins 6-3. The gear 4-3-2 of the transmission device 4 is connected with the movable tool handle 2-3 by connecting pins 4-3-1 via the upper and lower cover boards 1-1 and 1-2, and the fixed tool handle 2-8 is connected by the connecting pins via upper and lower cover boards 1-1 and 1-2. The anti-backup mechanism 4-1 of the transmission device 4 is connected by the connecting pins 4-1-2 via the upper and lower cover boards 1-1 and 1-2. The advancement mechanism 4-2 of the transmission device 4 is connected with the movable tool handle 2-3 by advancement connecting pins 4-2-2.

The coaxial tool head comprises a movable tool head 6-5, 1-1, 1-2 and a fixed tool head 6-4 (see FIGS. 2 and 5). The movable tool head 6-5 and fixed tool head 6-4 are provided with a circular concave part with the same size, respectively, and the center of the two concave parts is respectively provided with a hole with the same size being connected with the upper lower board 1-1 and the lower cover board 1-2 by link pins 6-3. There is a fixed screw 6-1 on the fixed tool head 6-4 and a fixed screw 6-8 on the movable tool head 6-5. The spring 6-2 for opening and closing the jaw of the movable tool head is connected with the fixed screw 6-1 and the fixed screw 6-8, respectively. Gear 6-5-*a* is disposed under the movable tool head 6-5 (see FIGS. 2 and 5).

The adjustable jaw structure 3 (see FIG. 2) comprises a screw 3-2 of the adjustable jaw structure and a screw cap 3-1 of the adjustable jaw structure. There is a hole, the diameter of which is the same as the external diameter of the screw cap 3-1, on the movable tool head 6-5. The screw cap 3-1 is inserted into the hole of the movable tool head, and the screw 3-2 is screwed into the screw cap 3-1. There are corresponding circle numbers disposed between the screw 3-2 and the screw cap 3-1 for adjusting the opening degree of the jaw.

The conforming-indicating device 5 which produces an audio or visual signal when the tool handle closes to certain designated position under the action of the transmission device is a mechanical mechanism conforming-indicating device 5-*a*.

The mechanical mechanism conforming-indicating device 5-*a* comprises two parts (see FIGS. 2, 3-*a* and 5): one part is an audio or visual signal spring 5-1 being connected with the movable tool head 6-5 by screw 5-2, and the other part is an audio or visual signal spring 5-3 being connected with the fixed tool handle 2-8 by screw 5-4 and screw III 5-5.

The tool handle structure 2, which conforms to human engineering (see FIGS. 1, 4 and 5), comprises a movable tool handle 2-3 and a fixed tool handle 2-8, with the movable tool handle 2-3 being connected with the gear 4-3-2 by link pins 4-1-2 via cover boards 1-1, 1-2 and holes on the two tool handles of the fixed tool handle 2-8 respectively being connected with upper and lower cover boards 1-1, 1-2 by connecting pin 2-4 and connecting pin 2-5. The tool handles are connected by a spring 2-7. One end of the spring 4-1-4 is connected with a fixed screw 2-6 disposed at one side of the fixed tool handle 2-8, and the other end of the spring is connected with the backstop 4-1-1. The shape of the two tool handles is structured to be comfortable for users to use and laborsaving.

The anti-backup mechanism 4-1 of the transmission device 4 comprises a backstop 4-1-1 which prevents the return of the movable tool head and a spring 4-1-4. One end of the backstop 4-1-1 is teeth shaped and the other end is provided with a small hole which is connected with one end of the spring 4-1-4, the other end of the spring 4-1-4 is connected by fixed screw 2-6 disposed inside the fixed tool handle 2-8.

The advancement mechanism 4-2 of the transmission device 4 is disposed inside the movable tool handle 2-3 and comprises an advancement 4-2-1 and spring 4-2-3 (see FIG. 5). One end of the advancement 4-2-1 is teeth shaped and the other end is provided with a small hole which is connected with one end of the spring 4-2-3, and the other end of the spring 4-2-3 is connected with the fixed pin 2-2 which is inserted in the movable tool handle 2-3. The teeth shaped end of the advancement 4-2-1 is engaged with the gear 4-3-2. The advancement is fixed inside the movable tool handle 2-3 by advancement connecting pins 4-3-1.

The cover board structure 1 comprises two bending boards which include upper cover board 1-1 and lower cover board 1-2 (see FIG. 5). The upper and lower cover boards 1-1 and 1-2 are coaxially connected to the movable tool head 6-5 and fixed tool head 6-4, respectively, by link pins 6-3. The gear 4-3-2 and the movable tool handle 2-3 are disposed between the upper and lower cover boards 1-1, 1-2. The backstop 4-1-1 is disposed between the upper and lower cover boards 1-1, 1-2 and connected to the upper and lower cover boards 1-1, 1-2 by connecting pins 4-1-2. The fixed tool handle 2-8 is fixed between the upper and lower cover boards 1-1, 1-2 by pins on the fixed tool handle 2-8.

In another example, a ratchet crimping tool (see FIGS. 1 and 5), comprises a tool head cover board structure 1 comprising an upper cover board 1-1 and a lower cover board 1-2, a tool handle structure 2 comprising a movable tool handle 2-3 and a fixed tool handle 2-8, a transmission device 4 comprising an anti-backup mechanism 4-1, an advancement mechanism 4-2, and a gear structure 4-3, and a tool head. The step tool uses a coaxial tool head 6, a confirming-indicating device 5 and an adjustable jaw structure 3. The coaxial tool head 6 comprises a movable tool head 6-5 and a fixed tool head 6-4, and the gear **6-5-*a* of the movable tool head is engaged with the gear 4-3-2 of the transmission device 4. The adjustable jaw structure 3 is connected with the movable tool head 6-5. The conforming-indicating device 5 is connected with the movable tool head 6-5 and the fixed tool handle 2-8, respectively. The coaxial tool head 6 is connected with the tool head cover board structure 1 by the link pins 6-3. The gear 4-3-2 of the transmission device 4 is connected with the movable tool handle 2-3 by connecting pins 4-3-1 via the upper and lower cover boards 1-1 and 1-2, and the fixed tool handle 2-8 is connected by the connecting pins via upper and lower cover boards 1-1 and 1-2. The anti-backup mechanism 4-1 of the transmission device 4 is connected by the connecting pins 4-1-2 via upper and lower cover boards 1-1, 1-2. The advancement mechanism 4-2 of the transmission device 4 is connected with the movable tool handle 2-3 by the advancement connecting pins 4-2-2**.

The coaxial tool head comprises a movable tool head 6-5 and a fixed tool head 6-4 (see FIGS. 2 and 5). The movable tool head 6-5 and fixed tool head 6-4 are provided with a circular concave part with generally the same size, respectively, and the center of the two concave parts is respectively provided with a hole with the same size being connected with the upper lower board 1-1 and lower cover board 1-2 by link pins 6-3. There is a fixed screw 6-1 on the fixed tool head 6-4 and a fixed screw 6-8 on the movable tool head 6-5. The spring 6-2 for opening and closing the jaw of the movable tool head is connected with the fixed screw 6-1 and the fixed screw 6-8, respectively. Gear **6-5-*a* is disposed under the movable tool head 6-5 (see FIGS. 2 and 5**).

The adjustable jaw structure 3 (see FIG. 2) comprises a screw 3-2 of the adjustable jaw structure and a screw cap 3-1 of the adjustable jaw structure. There is a hole, the diameter of which is generally the same as the external diameter of the screw cap 3-1, on the movable tool head 6-5. The screw cap 3-1 is inserted into the hole of the movable tool head, and the screw 3-2 is screwed into the screw cap 3-1. There are corresponding circle numbers disposed between the screw 3-2 and the screw cap 3-1 for adjusting the opening degree of the jaw.

The confirming-indicating device 5 which produces audio or visual signal when the tool handle closes to a certain designated position under the action of the transmission device is a electronic mechanism confirming-indicating device **5-*b***.

The electronic mechanism confirming-indicating device **5-*b* (see FIGS. 2, 3-*b* and 5) comprises a contact of movable tool head 5-6, a contact of cover board 5-7, metal sheet positive and negative plates 5-8, a battery box 5-9, a battery 5-10, a spring 5-11, a signal device 5-12 and a conducting wire 5-13. The contact of movable tool head 5-6 and the contact of cover board 5-7 are respectively disposed inside the movable tool head 6-5 and inside the upper cover board 1-1. The metal plate 5-8, battery box 5-9, battery 5-10, spring 5-11 and signal device 5-12 are disposed inside the fixed tool handle 2-8. The contact of cover board 5-7 is connected with the metal sheet positive electrode plate of the battery 5-8, and the metal sheet negative plate 5-8 of the battery is connected with the negative electrode of the signal device 5-12. The positive electrode of the signal device 5-12 is connected with the fixed tool handle 2-8. When the movable tool head 6-5 is closed to a designated position, the contact of the movable tool head 5-6 contacts with the contact of cover board 5-7, which means the positive electrode and negative electrode of battery contact, then the signal device 5-12** produces audio or visual signal.

The tool handle structure 2, which conforms to human engineering (see FIGS. 1, 4 and 5), comprises a movable tool handle 2-3 and fixed tool handle 2-8, with the movable tool handle 2-3 being connected with the gear 4-3-2 by connecting pins 4-1-2 via cover boards 1-1, 1-2 and the holes on the two tool handles of the fixed tool handle 2-8 respectively being connected with the upper and lower cover boards 1-1, 1-2 by connecting pin 2-4 and connecting pin 2-5. The tool handles are connected by spring 2-7. The fixed screw 2-6 disposed at one side of the fixed tool handle 2-8 is connected with one end of the spring 4-1-4, the other end of which is connected with the backstop 4-1-1. The shape of the two tool handles is structured to be comfortable for users to use and laborsaving.

The anti-backup mechanism 4-1 of the transmission device 4 comprises a backstop 4-1-1 which prevents the return of the movable tool head, and a spring 4-1-4 (see FIG. 5). One end of the backstop 4-1-1 is teeth shaped and the other end is provided with a small hole which is connected with one end of the spring 4-1-4, and the other end of the spring 4-1-4 is connected with the fixed screw 2-6 disposed inside the fixed tool handle 2-8.

The advancement mechanism 4-2 of the transmission device 4 is disposed inside the movable tool handle 2-3 and comprises advancement 4-2-1 and spring 4-2-3. One end of the advancement 4-2-1 is teeth shaped and the other end is provided with small hole which is connected with one end of the spring 4-2-3, and the other end of the spring 4-2-3 is connected with the fixed pin 2-2 which is inserted in the movable tool handle 2-3. The teeth shaped end of the advancement 4-2-1 is engaged with the gear 4-3-2, and the advancement is fixed inside the movable tool handle 2-3 by advancement connecting pins 4-3-1.

The cover board structure 1 comprises two bending boards which comprise upper cover board 1-1 and lower cover board 1-2 (see FIG. 5). The upper cover board 1-1 and lower cover board 1-2 are coaxially connected to the movable tool head 6-5 and fixed tool head 6-4 by link pins 6-3, respectively. Gear 4-3-2 and the movable tool handle 2-3 are disposed between the upper and lower cover boards 1-1, 1-2. The backstop 4-1-1 is disposed between the upper and lower cover boards 1-1, 1-2 and connected to the upper and lower cover boards 1-1, 1-2 by connecting pins 4-1-2. The fixed tool handle 2-8 is fixed between the upper and lower cover boards 1-1, 1-2 by pins on the fixed tool handle 2-8.

Operation of this embodiment is as follows. First, begin by adjusting the adjustable jaw structure 3, and screwing screw 3-2 moved in or out of the adjustable jaw structure. Next, grasp the fixed tool handle 2-8, and repeatedly move the movable tool handle 2-3 with fingers. At that time, the spring 2-7 shrinks and meanwhile the spring 4-2-3 drives the advancement 4-2-1 around the pin 4-2-2, and gear teeth at the other end of the advancement drives the gear 4-3-2 around the link pin 4-3-1. Gear 4-3-2 drives the gear teeth of the movable tool head 6-5, and the gear 4-3-2 is engaged with gear teeth 6-5-*a* of the movable tool head to drive the movable tool head around the link pin 6-3 placidly, under the action of spring 6-2. Each time the advancement repeats driving the gear, the teeth of the backstop 4-1-1 drives the movable tool head 6-5 to prevent the return of gear teeth 6-5-*a* of the movable tool head 6-5, consequently preventing the receding of the movable tool head 6-5. Repeatedly move the movable tool handle to close the fixed tool head, meanwhile adjust screw 3-2 of the adjustable jaw structure to support the cover board pin 1-3, while simultaneously hearing an audio or seeing a visual signal. Thereby the work is finished with the tool. Then, move the return pin 4-1-3 to make the tool handle return back to its naturally open state. During operation of the transmission device 4, use the backstop to move teeth of the movable tool head, which prevents the return of the movable tool head.

A specific way of implementing above provides a general description of the disclosure. However, the two embodiments are just representative examples for general understanding, and do not constitute the limits for the disclosure. And also, according to the description of the technical scheme and embodiments of the disclosure, any possible similar change or replacement can be made, and such change or replacement shall be considered within the protection scope of claims of the disclosure.

What is claimed is:

1. A ratchet crimping tool comprising:

a tool head cover board structure comprising an upper cover board and a lower cover board;

a tool handle structure comprising a movable tool handle and a fixed tool handle;

a transmission device comprising an anti-backup mechanism, an advancement mechanism and a gear structure; and a coaxial tool head comprising a movable tool head and a fixed tool head;

wherein the ratchet crimping tool uses the coaxial tool head, a confirming-indicating device and an adjustable jaw structure, wherein a gear of the movable tool head is engaged with the gear structure of the transmission device, the adjustable jaw structure is connected with the movable tool head and the confirming-indicating device is connected with the movable tool head and the fixed tool handle respectively; wherein the coaxial tool head is connected with the tool head cover board structure by a link pin, and the gear structure of the transmission device is connected with the movable tool handle by a first connecting pin via the upper and lower cover boards; the fixed tool handle is connected with the anti-backup mechanism of the transmission device by a second connecting pin via the upper and lower cover boards; and wherein the advancement mechanism of the transmission device is connected with the movable tool handle by an advancement connecting pin.

2. The ratchet crimping tool of claim 1, wherein the movable tool head and fixed tool head are each provided with a circular concave part that are generally the same size, and wherein a center of the two concave parts is respectively provided with a hole with generally the same size; and the holes are connected with the upper and lower cover boards by the link pin; and there is a fixed screw on the fixed tool head and a fixed screw on the movable tool head, wherein springs for opening and closing a jaw of the movable tool head are respectively connected with the fixed screws, and the gear of the movable tool head is disposed under the movable tool head.

3. The ratchet crimping tool of claim 1, wherein the adjustable jaw structure comprises a screw and a screw cap, and the movable tool head includes a hole, a diameter of which is generally the same as an external diameter of the screw cap, and the screw cap is inserted into the hole of the movable tool head, and the screw is screwed into the screw cap; and there are corresponding circle numbers disposed between the screw and the screw cap for adjusting an opening degree of a jaw of the movable tool head.

4. The ratchet crimping tool of claim 1, wherein the confirming-indicating device is configured to produce at least one of an audio or visual signal when the tool handle structure closes to a certain predetermined position under the action of the transmission device and wherein the confirming-indicating device is one of a mechanical mechanism confirming-indicating device or an electronic mechanism confirming-indicating device.

5. The ratchet crimping tool of claim 4, wherein the mechanical mechanism confirming-indicating device comprises the following two portions:

a first portion including a first audio or visual signal spring connected with the movable tool head by a first screw, and a second portion including a second audio or visual signal spring connected with the fixed tool handle by a second screw and a third screw.

6. The ratchet crimping tool of claim 4, wherein the electronic mechanism confirming-indicating device comprises a contact of the movable tool head, a contact of a cover board, metal sheet positive and negative plates, a battery box, a battery, a spring, a signal device and one or more conducting wires;

wherein the contact of the movable tool head and the contact of the cover board are respectively disposed inside the movable tool head and inside the upper cover board;

wherein the metal sheet plates, battery box, battery, spring and signal device are disposed inside the fixed tool handle;

wherein the contact of the cover board is connected with a metal sheet positive electrode plate of the battery, and a metal sheet negative electrode plate of the battery is connected with a negative electrode of the signal device and a positive electrode of the signal device is connected with the fixed tool handle;

wherein when the movable tool handle is closed to a designated position, the contact of the movable tool head contacts with the contact of the cover board, such that the positive electrode and the negative electrode of the battery contact and the signal device produces an audio or visual signal.

7. The ratchet crimping tool of claim 1, wherein the movable tool handle is connected with the gear structure by a link pin via a cover board and holes on the fixed tool handle are connected with the upper and lower cover boards by connecting pins; wherein the moveable and fixed tool handles are connected by a first spring; a fixed screw disposed at one side of the fixed tool handle being connected with one end of a second spring, the other end of the second spring being connected with a backstop of the anti-backup mechanism; and wherein a shape of each of the fixed and moveable tool handles is ergonomically structured.

8. The ratchet crimping tool of claim 1, wherein the anti-backup mechanism of the transmission device comprises a spring and a backstop which prevents return of the movable tool handle; one end of the backstop being teeth shaped and the other end being provided with a small hole which is connected with one end of the spring, and the other end of the spring being connected with a fixed screw disposed inside the fixed tool handle.

9. The ratchet crimping tool of claim 1, wherein the advancement mechanism of the transmission device is disposed inside the movable tool handle and comprises an advancement and a spring; one end of the advancement being teeth shaped and the other end being provided with a small hole which is connected with one end of the spring, and the other end of the spring is connected with a fixed pin which is inserted in the movable tool handle; the teeth shaped end of the advancement being engaged with a gear of the gear structure while the advancement is fixed inside the movable tool handle by the advancement connecting pins.

10. The ratchet crimping tool of claim 1, wherein the upper and lower cover boards comprise bending boards, wherein the upper and lower cover boards are coaxially connected to the movable tool handle and fixed tool handle by the link pin; a gear of the gear structure and the movable tool handle being disposed between the upper and lower cover boards, and a backstop of the anti-backup mechanism being disposed between the upper and lower cover boards and connected to the upper and lower cover boards by the second connecting pin; the fixed tool handle being fixed between the upper and lower cover boards by connecting pins on the fixed tool handle.

11. A ratchet crimping tool comprising:

a tool head cover board structure comprising an upper cover board and a lower cover board;

a tool handle structure comprising a movable tool handle and a fixed tool handle;

a transmission device comprising an anti-backup mechanism, an advancement mechanism and a gear structure, wherein the gear structure is connected with the movable tool handle by first connecting pins via the upper and lower cover boards, the anti-backup mechanism is connected with the fixed tool handle by second connecting pins via the upper and lower cover boards and the advancement mechanism is connected with the movable tool handle by advancement connecting pins;

a coaxial tool head comprising a movable tool head and a fixed tool head, wherein a gear of the movable tool head is engaged with the gear structure of the transmission device, the coaxial tool head being connected with the tool head cover board structure by a link pin;

a confirming-indicating device connected with the movable tool head and the fixed tool handle; and an adjustable jaw structure connected with the movable tool head.

* * * * *